US005959542A

United States Patent [19]

Ishida

[11] Patent Number: 5,959,542

[45] **Date of Patent: *Sep. 28, 1999**

[54] SELECTIVE CALLING RECEIVER

[75] Inventor: Hiromichi Ishida, Shizuoka, Japan

[73] Assignee: NEC Corporation, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/699,484

[22] Filed: Aug. 16, 1996

[30] Foreign Application Priority Data

Aug. 21, 1995 [JP] Japan ..... 7-211602

[51] Int. Cl.[6] ..... G08B 5/22

[52] U.S. Cl. ..... 340/825.44; 455/38.2; 340/825.47; 340/825.52

[58] Field of Search ..... 340/825.44, 825.47, 340/311.1, 825.48, 825.22, 825.54; 379/88; 455/186.1, 70, 31.2, 38.2

[56] References Cited

U.S. PATENT DOCUMENTS 5,146,217 9/1992 Holmes et al. ..... 340/825.44
5,349,696 9/1994 Matai ..... 455/70

FOREIGN PATENT DOCUMENTS 60-197029 10/1985 Japan .
2200050 8/1990 Japan .
2149164 6/1985 United Kingdom .
WO 91/02434 2/1991 WIPO .

OTHER PUBLICATIONS

European Search Report, Nov. 15, 1996.

*Primary Examiner*—Michael Horabik
*Assistant Examiner*—Jean B. Jeanglaude
*Attorney, Agent, or Firm*—Whitham, Curtis & Whitham

[57] ABSTRACT

In a selective calling receiver, receiving windows are previously set which include a protection window provided with a predetermined protection condition and a non-protection window. The receiving windows may be call addresses which are previously assigned to the selective calling receiver or may be receiving time windows through one of which the selective calling signal is received. When a selective calling signal is received through the protection window, the received message is stored into a first memory. When a selective calling signal is received through the non-protection window, the received message is stored into a second memory. The messages stored in the first memory and the second memory are managed such that a first message stored in the first memory is manipulated based on the predetermined protection condition associated with the first message.

30 Claims, 7 Drawing Sheets

FIG. 2

ADDRESS TIME-LIMIT SETTING DATA TABLE 106

| ADDRESS $ADDR_i$ | PROTECTION PERIOD $T_{PPi}$ | DELETION/TRANSFER AFTER EXPIRATION |
|---|---|---|
| $ADDR_1$ | ONE WEEK | DEL |
| $ADDR_2$ | ONE MONTH | TRANS |
| $ADDR_3$ | — | — |
| ⋮ | ⋮ | ⋮ |
| $ADDR_N$ | INDEFINITE | — |

FIG. 3

DESIGNATED PERIOD TIME-LIMIT SETTING DATA TABLE 107

| DESIGNATED RECEIVING TIME PERIOD $T_{DRCV}$ | PROTECTION PERIOD $T_{PPk}$ | DELETION/TRANSFER AFTER EXPIRATION |
|---|---|---|
| 8:00-17:00 | ONE MONTH | TRANS |
| 17:00-23:00 | ONE WEEK | DEL |
| ⋮ | ⋮ | ⋮ |

FIG. 5

PROTECTED MESSAGE TABLE 105

| MESSAGE | EXPIRATION DATE $T_{EX}$ | DEL/TRANS AFTER EXPIRATION |
|---|---|---|
| ⋮ | ⋮ | ⋮ |
| $M_j$ | $T_{EXj}$ | DEL |
| $M_{j+1}$ | $T_{EXj+1}$ | TRANS |
| ⋮ | ⋮ | ⋮ |

FIG. 6

MESSAGE MAIN TABLE 104

| MESSAGE | DATE AND TIME OF RECEPTION $T_R$ |
|---|---|
| ⋮ | ⋮ |
| $M_k$ | $T_{Rk}$ |
| $M_{k+1}$ | $T_{Rk+1}$ |
| ⋮ | ⋮ |

SELECTIVE CALLING RECEIVER

BACKGROUND OF THE INVENTION

1. Field of the Invention

The present invention generally relates to a selective calling receiver, and in particular to a method and system for managing received messages which are stored in a message memory.

2. Description of the Related Art

A selective calling receiver has been widely used for various purposes and, especially, a small-sized and light-weight selective calling receiver called a pager is suitable for being taken on the road. A basic function of the selective calling receiver is to indicate by beep sound, vibration, or light the incoming call and then to display a received message on an liquid-crystal display (LCD). The received message is first stored in a message memory and is then read out from the message memory to be displayed on screen according to user's key operations. Since a plurality of received messages are usually stored in the message memory, message management becomes important.

A message management scheme in a paging system has been disclosed in Japanese Patent Unexamined Publication No. 60-197029. In this paging system, a center system has the message management function including a selective calling data storage function, a calling time management function, and a selective calling data transmission control function. Another message management scheme in a paging system has been disclosed in Japanese Patent Unexamined Publication No. 2-200050. This system is provided with a message storage unit having message storage areas and a controller. The controller searches the message storage areas for all messages addressed to a receiving terminal and sends them to the terminal.

However, such a message management scheme mentioned above is not implemented in a receiving terminal or a pager but at the center system. In a receiving terminal, a received message is stored into the message memory until the message memory becomes full. When the message memory reaches capacity, the oldest message is automatically deleted from and the latest is stored into the message memory. Therefore, a necessary message may be deleted without knowledge of the user. On the other hand, in the case where a necessary message is protected, the message is stored in the message memory for indefinitely long time periods until it is deleted by the user consciously, resulting in unnecessarily reduced memory area.

SUMMARY OF THE INVENTION

An object of the present invention is to provide a message management method which protects necessary messages with reliability and prevents the messages from being stored in a message memory for a unnecessarily long time.

Another object of the present invention is to provide a message management method which automatically protects and manipulates necessary messages stored in a message memory.

According to the present invention, a predetermined number of receiving windows are previously set which include a protection window and a non-protection window. The protection window is provided with a predetermined protection condition. The receiving windows may be call addresses (ID numbers) which are previously assigned to the selective calling receiver. The receiving windows may be receiving time windows through one of which the selective calling signal is received. A receiving time window is set to, for example, 8:00 am–5:00 pm in a day.

When a selective calling signal is received through the protection window, the received message is stored into a first memory. On the other hand, when a selective calling signal is received through the non-protection window, the received message is stored into a second memory. The messages stored in the first memory and the second memory are managed such that a first message stored in the first memory is manipulated based on the predetermined protection condition associated with the first message.

Preferably, the predetermined protection condition comprises a protection period during which the message is protected from being deleted and a manipulation instruction which is to be performed when the protection period is expired. The first message stored in the first memory is manipulated according to the manipulation instruction when the protection period is expired. More specifically, the manipulation instruction is either a deletion instruction or a transfer instruction which is designated by the user. The deletion instruction deletes the first message from the first memory and the transfer instruction transfers the first message from the first memory to the second memory when the protection period is expired.

Further, the predetermined protection condition may be released from the first message stored in the first memory to transfer the first message from the first memory to the second memory according to a user's instruction. A protection condition of a second message stored in the second memory may be set and the second message is transferred from the second memory to the first memory according to a user's instruction.

As described above, according to the present invention, a protection condition can be previously set for each receiving windows. Therefore, a message received through a protection window is automatically stored into the first memory and another message received through a non-protection window is automatically stored into the second memory. More specifically, in the case where the protection condition includes a protection period, the expiration management of messages can be performed by referring to the first memory. Further, since the message stored in the first memory is deleted or transferred to the second memory according to the protection condition preset by the user, effective message management can be made by referring to the first memory.

BRIEF DESCRIPTION OF THE DRAWINGS

FIG. 2 is a schematic diagram showing an example of an address time-limit setting data table in the embodiment;

FIG. 3 is a schematic diagram showing an example of a designated period time-limit setting data table in the embodiment;

FIG. 5 is a schematic diagram showing an example of the protected message table in the embodiment;

FIG. 6 is a schematic diagram showing an example of a message main table in the embodiment;

DETAILED DESCRIPTION OF THE PREFERRED EMBODIMENTS

Figure 1:
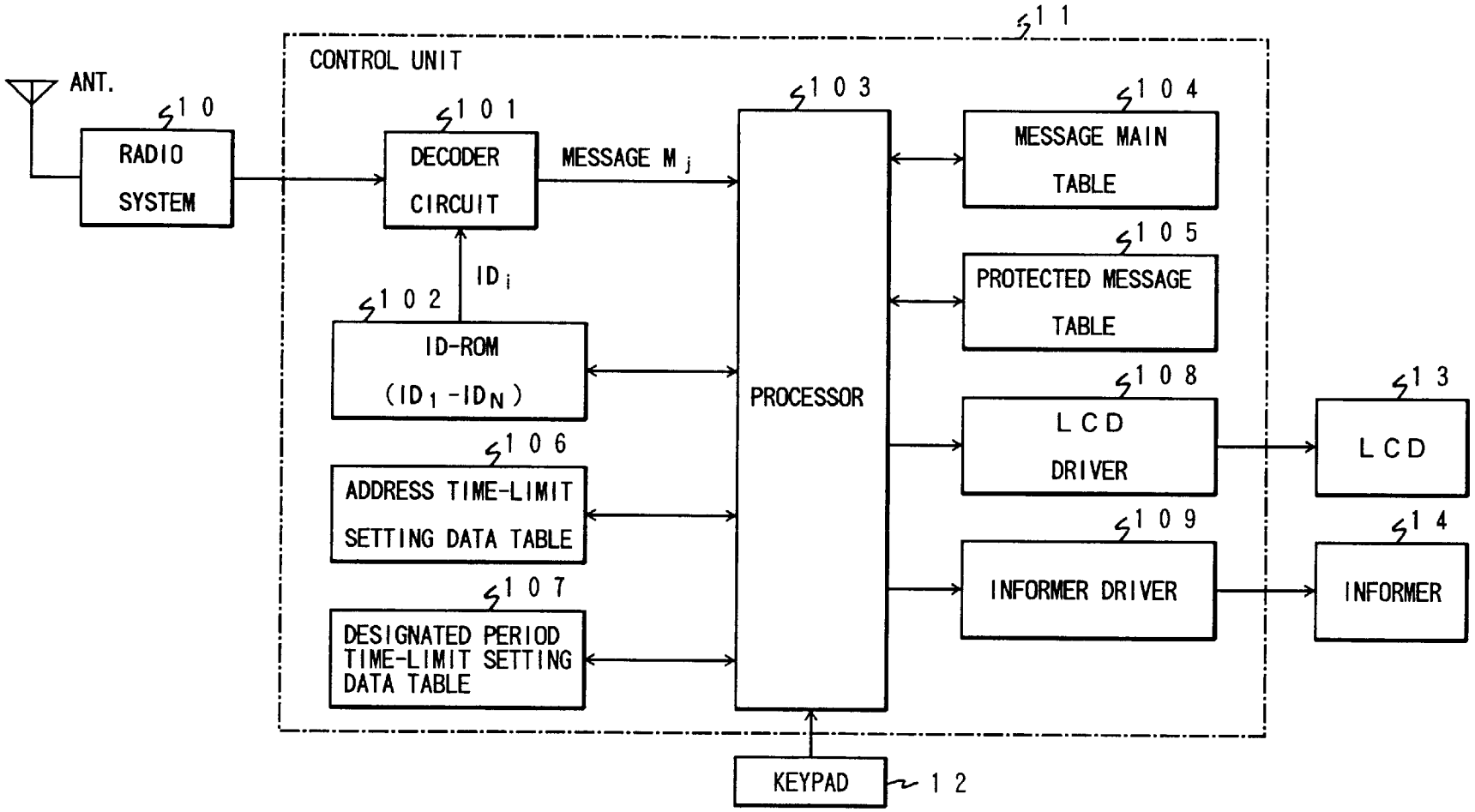
FIG. 1 is a functional block diagram showing the circuit arrangement of a radio selective calling receiver according to an embodiment of the present invention.

Referring to FIG. 1, there is shown a selective calling receiver in accordance with the present invention. The selective calling receiver is comprised of a radio system 10, a control unit 11 which is connected to a battery (not shown), a keypad 12 including a mode selector and other function keys, a liquid-crystal display (LCD) 13, and an informer 14 such as a speaker or vibrator. The radio system is comprised of a built-in antenna and a radio receiver which receives a digital-modulated radio signal from a radio base station (not shown) of a selective calling system through the antenna. The radio system 10 further includes a digital demodulator which demodulates the received radio signal into a baseband signal. After the waveform of the baseband signal is shaped, the wave-shaped signal is transferred as a selective calling signal from the radio system 10 to the control unit 11.

The control unit 11 includes a decoder circuit 101 which receives the selective calling signal from the radio system 10 and decodes it into received data. In this embodiment, the decoder circuit 101 further sequentially compares a selective calling number included in the received data with one of a plurality of identification numbers ($ID_1$–$ID_N$) previously stored in an ID ROM 102 under the control of a processor 103. When the selective calling number included in the received data is identical to IDi (i=1, 2, . . . , N) which is one of the ID numbers $ID_1$–$ID_N$, a received message Mj included in the received data is transferred from the decoder circuit 101 to one selected from the message main table 104 and a protected message table 105 under the control of the processor 103, which will be described later.

The processor 103 receives not only the received message from the decoder circuit 101 but also user's key instructions from the keypad 12. As described in detail later, time-limit setting data for message protection are determined and stored into an address time-limit setting data table 106 and a designated period time-limit setting data table 107 by the user operating the keypad 12 (see FIGS. 2 and 3 and FIG. 9). The address time-limit setting data table 106 stores time-limit setting data for each of addresses ADDRs which correspond to the ID numbers $ID_1$–$ID_N$, respectively. The designated period time-limit setting data table 107 stores time-limit setting data for each designated receiving time period $T_{DRCV}$. The message main table 104, the protected message table 105, the address time-limit setting data table 106, and the designated period time-limit setting data table 107 may be formed in a random-access memory (RAM).

When an incoming call occurs at the ID number IDi, the processor 103 controls an informer driver 109 such that the informer 14 is activated. Further, when receiving a read request from the keypad 12, the processor 103 reads the received message from either the message main table 104 or the protected message table 105 and then sends the message to an LCD driver 108 to display it on the LCD 13. Since the message main table 104 is used as a normal memory and the protected message table 105 as a protected memory, messages stored in the message main table 104 are automatically deleted according to FIFO (first-in first-out) and protected messages stored in the protected message table 105 are basically protected until the expiration of the protection period Tpp as described later.

Needless to say, the processor 103 includes a time-of-day clock (not shown) for stamping a received message with date and time of reception and checking the expiration of a set protection time period. The processor 103 further includes a program ROM (not shown) which stores an operating program and other necessary function programs.

PROTECTIVE RECEIVING WINDOW

As illustrated in FIG. 2, the address time-limit setting data table 106 stores time-limit setting data for each of call addresses ADDRs which correspond to the ID numbers $ID_1$–$ID_N$, respectively. In other words, each of the call addresses ADDRs is used as a protection window. More specifically, the protection period $T_{ppi}$ of a call address $ADDR_i$ is set to a time period determined by the user operating the keypad 12. The protection period $T_{ppi}$ is set to, for example, one week, one month, or an indefinite period. Further, the user selects deletion (DEL) or transfer (TRANS) of the received message after the expiration of the protection period $T_{ppi}$. In the case where deletion (DEL) is selected, the received message is deleted from the protected message table 105 after the expiration of the protection period $T_{ppi}$. In the case where transfer (TRANS) is selected, the received message is transferred from the protected message table 105 to the message main table 104 after the expiration of the protection period $T_{ppi}$.

For example, in the case where the protection period $T_{pp1}$ of the address $ADDR_1$ is set to one week and the deletion DEL is designated, a message received at the address $ADDR_1$ is stored onto the protected message table 105 together with the protection period $T_{pp1}$ of one week and the deletion DEL designation. Therefore, the message is protected from being deleted until one week has elapsed, but, after a lapse of one week, the message is automatically deleted from the protected message table 105. On the other hand, in the case where the protection period $T_{pp2}$ of the address $ADDR_2$ is set to one month and the transfer TRANS is designated, a message received at the address $ADDR_2$ is stored onto the protected message table 105 together with the protection period $T_{pp2}$ of one month and the transfer TRANS designation. Therefore, the message is protected from being deleted until one month has elapsed, but, after a lapse of one month, the message is automatically transferred from the protected message table 105 to the message main table 104. In FIG. 2, the address $ADDR_3$ is not set and the address $ADDR_N$ is set to "Indefinite".

As illustrated in FIG. 3, the designated period time-limit setting data table 107 stores time-limit setting data for each designated receiving time period $T_{DRCV}$ which is used as a protection window. More specifically, the user uses the keypad 12 to designate a receiving time period $T_{DRCV}$. A received message which was received during the designated receiving time period $T_{DRCV}$ is protected for a protection period $T_{ppk}$ determined by the user operating the keypad 12. The protection period $T_{ppk}$ is set to, for example, one week, one month, or an indefinite period. Time periods other than the designated receiving time periods $T_{DRCV}$ are not set. Further, the user selects deletion (DEL) or transfer (TRANS) of the received message after the expiration of the protection period $T_{ppk}$.

Figure 9:
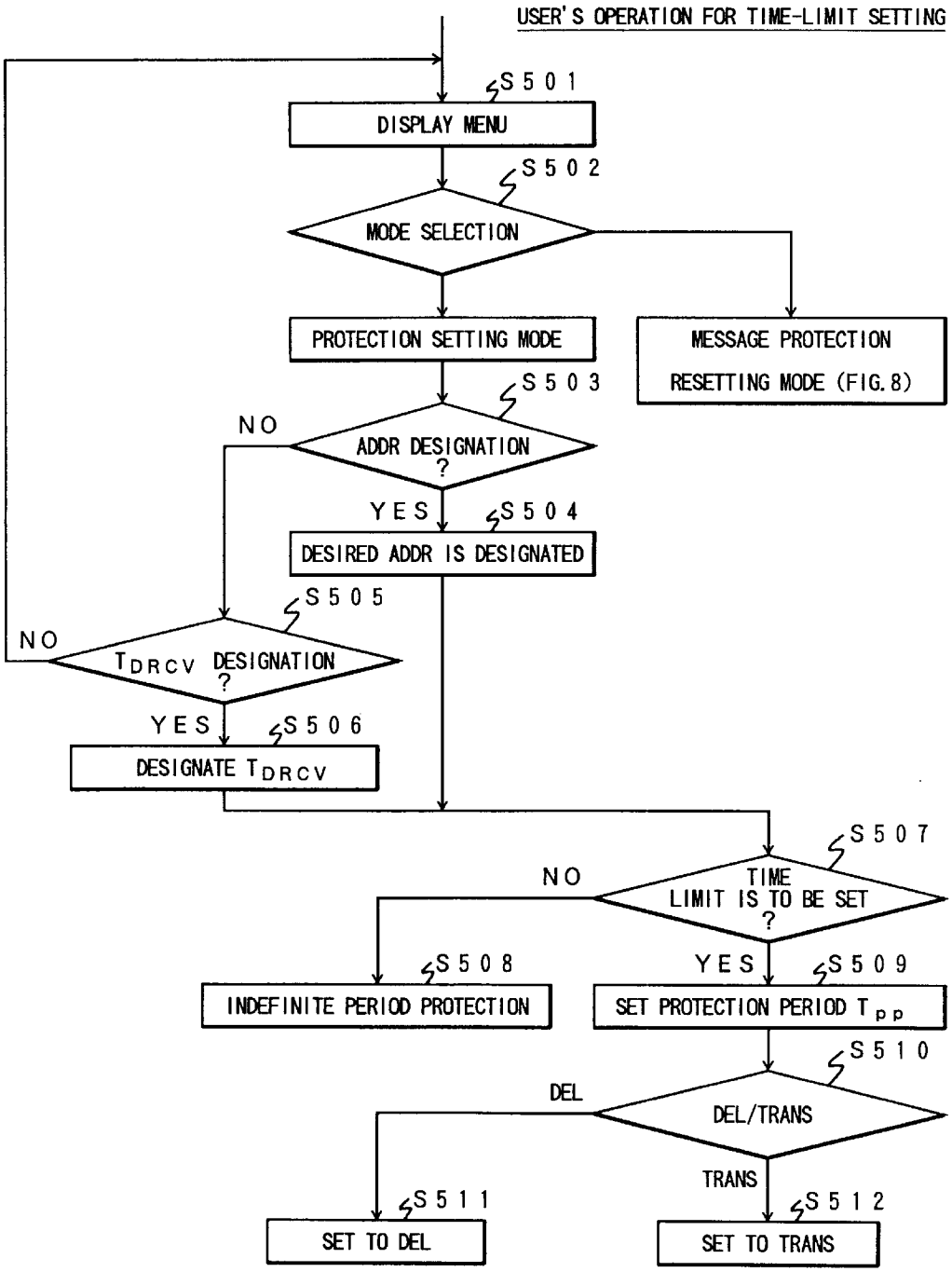
FIG. 9 is a flowchart showing a user's operation of setting protection periods and other necessary data.

It should be noted that the protection window or the time-limit setting data mentioned above are previously determined by the user operating the keypad 12 according to the sequence as shown in FIG. 9, which will be described later.

PROTECTED MESSAGE STORING

It is assumed that the address time-limit setting data table 106 and the designated period time-limit setting data table 107 are set to those as shown in FIGS. 2 and 3, respectively.

Figure 4:
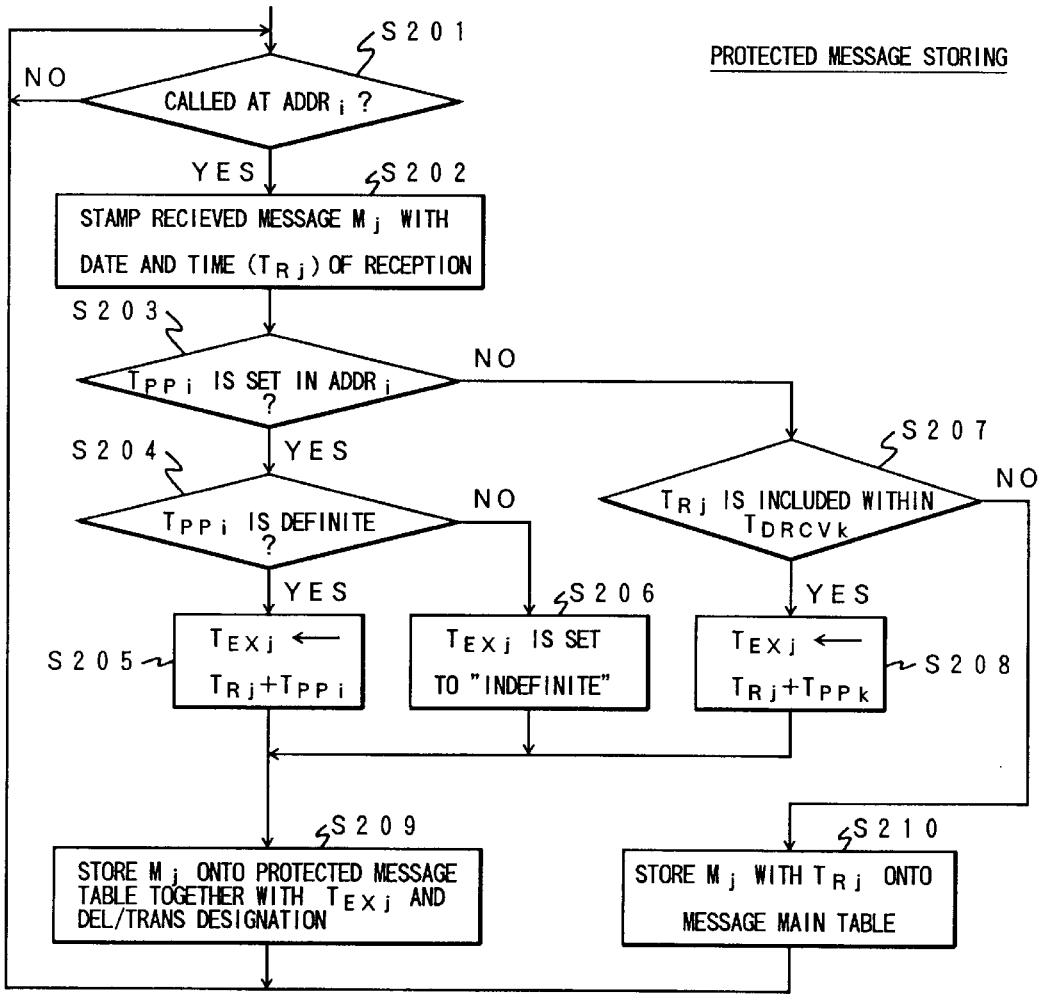
FIG. 4 is a flowchart showing a routine for storing a received message and its expiration data onto a protected massage table according to the embodiment.

Referring to FIG. 4, when an incoming call occurs at an address $ADDR_i$ (step S201), the processor 103 stamps a received message $M_j$ included in the received data with date and time of reception $T_{Rj}$ (step S202). Referring to the address time-limit setting data table 106, the processor 103 checks whether a protection period $Tpp_i$ is set in the address $ADDR_i$ (step S203) and, if the protection period $Tpp_i$ is set (YES in step S203), then it is checked whether the protection period $Tpp_i$ is definite or not (step S204). When the protection period $Tpp_i$ is definite (YES in step S204), the processor 103 calculates an expiration date $T_{EXj}$ by adding the date and time of reception $T_{Rj}$ to the protection period $Tpp_i$ (step S205). When the protection period $Tpp_i$ is not definite (NO in step S204), the expiration date $T_{EXj}$ is set to "Indefinite" (step S206).

If the protection period $Tpp_i$ is not set in the address $ADDR_i$ (NO in step S203), the processor 103, referring to the designated period time-limit setting data table 107, checks whether the date and time of reception $T_{Rj}$ is included within a designated receiving time period $T_{DRCVk}$ (step S207). When the date and time of reception $T_{Rj}$ is included within a designated receiving time period $T_{DRCVk}$ (YES in step S207), the processor 103 calculates the expiration date $T_{EXj}$ by adding the date and time of reception $T_{Rj}$ to the protection period $Tpp_k$ (step S208).

After the expiration date $T_{EXj}$ is determined, the received message $M_j$ is stored onto the protected message table 105 with accompanied by the expiration date $T_{EXj}$ and the DEL/TRANS designation (step S209). When the date and time of reception $T_{Rj}$ is included within a designated receiving time period $T_{DRCVk}$ (YES in step S207), the received message $M_j$ is stored into the message main table 104 accompanied by the date and time of reception $T_{Rj}$ (step S210).

In this manner, the protected message table 105 and the message main table 104 are formed as shown in FIGS. 5 and 6, respectively. Assuming that two addresses $ADDR_1$ and $ADDR_2$ are set to protection windows and other addresses are not set, all messages received at the addresses $ADDR_1$ and $ADDR_2$ are stored onto the protected message table 105 and other messages are stored onto the message main table 104.

EXPIRATION CHECK

Figure 7:
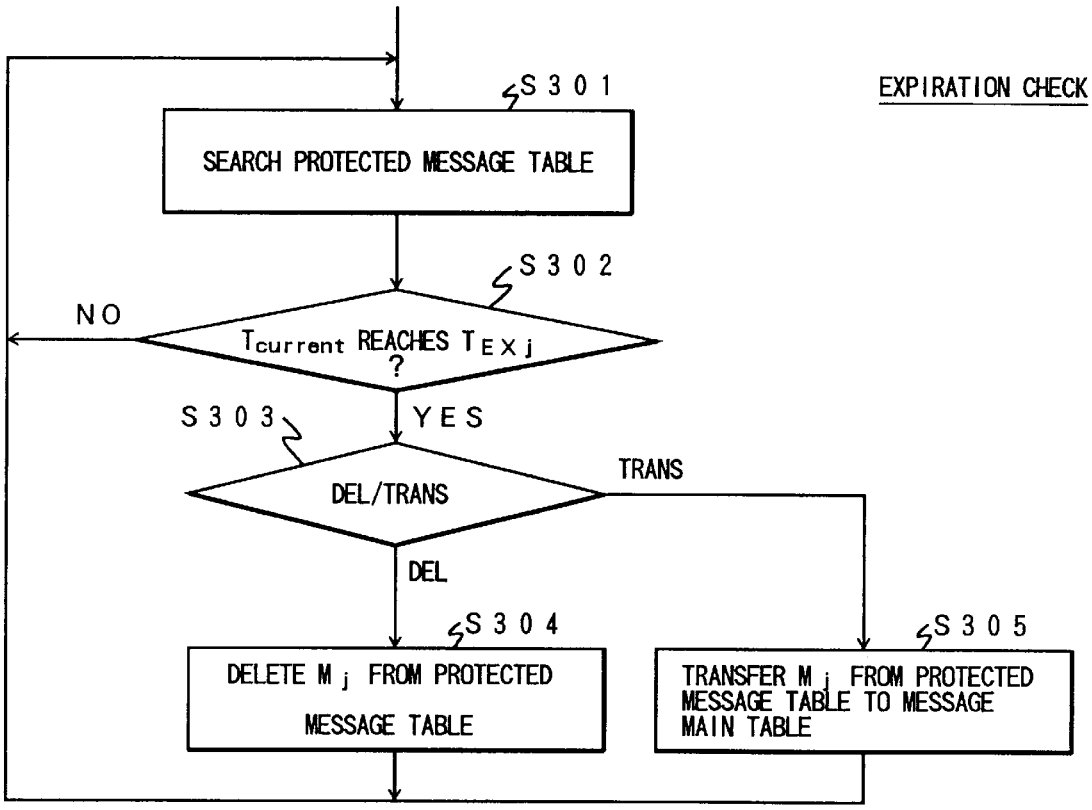
FIG. 7 is a flowchart showing a expiration check routine using the protected massage table according to the embodiment.

Referring to FIG. 7, using the time-of-day clock, the processor 103 checks at all times whether any expiration data $T_{EXj}$ is reached by searching the protected message table 105 (steps S301 and S302). When the current time $T_{current}$ reaches an expiration data $T_{EXj}$ (YES in step S302), it is further checked whether the DEL/TRANS designation of the expiration data $T_{EXj}$ is DEL or TRANS (step s303). When it is DEL, the message $M_j$ having the expiration data $T_{EXj}$ is deleted from the protected message table 105 (step S304). When TRANS, the message $M_j$ is transferred from the protected message table 105 to the message main table 104 (step S305).

MESSAGE PROTECTION RESETTING

As described above, messages received through a designated protection window are stored onto the protected message table 105 and other normal messages are stored onto the message main table 104. According to the embodiment, the message protection can be changed or the messages stored can be deleted by the user operating the keypad 12.

Figure 8:
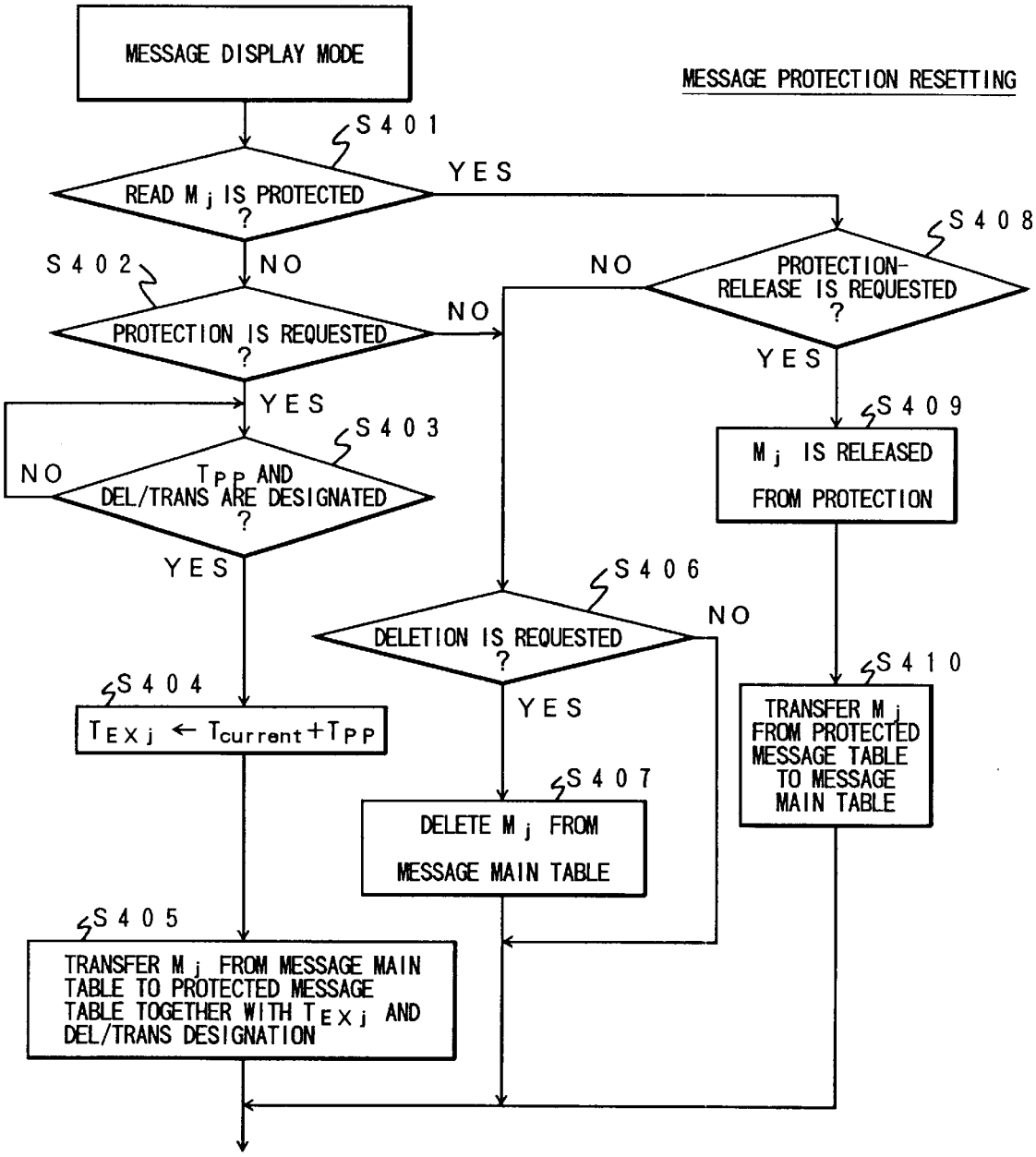
FIG. 8 is a flowchart showing a message resetting routine according to the embodiment.

Referring to FIG. 8, after selecting the message display mode, the user operates the keypad 12 to display a message $M_j$ on the LCD 13. In the case where the message $M_j$ is not protected (NO in step S401), the user is prompted for input whether the message $M_j$ is to be protected. When protection is requested (YES in step S402), the user is further prompted for input for a protection period Tpp and the DEL/TRANS designation. When these data are input (YES in step S403), the processor 103 calculates an expiration date $T_{EXj}$ by adding the current date and time $T_{current}$ to the protection period Tpp (step S404). After the expiration date $T_{EXj}$ is determined, the message $M_j$ is transferred from the message main table 104 to the protected message table 105 with accompanied by the expiration date $T_{EXj}$ and the DEL/TRANS designation (step S405). When protection is not requested (NO in step S402), the user is prompted for input whether the message $M_j$ is to be deleted. When deletion is requested (YES in step S406), the message $M_j$ is deleted from the message main table 104 (step S407).

In the case where the message $M_j$ has been protected (YES in step S401), the user is prompted for input whether the protection is to be released. When the protection release is requested (YES in step 5408), the message $M_j$ is released from rotection (step S409) and is then transferred from the protected message table 105 to the message main table 104 (step S410). When he protection release is not requested (NO in step S408), the steps S406 and S407 are performed as described above.

In this manner, the user can protect a message which has not been protected, release the protection of the protected message, or delete the message by operating the keypad 12.

USER'S OPERATION

Referring to FIG. 9, an initial menu is displayed on the LCD 13 and prompts the user to select a desired mode (step S501). When a protection setting mode is selected, the user is prompted to determine whether address designation is made or not (step S503). When the address designation is made (YES in step S503), the user designates a desired address ADDRi as a protection window (step S504). When the address designation is not made (NO in step S503), the user is prompted to determine whether designation of a receiving time period is made or not. When the designation of a receiving time period is made (YES in step S505), the user inputs the beginning time and the ending time through the keypad 12 to designate the receiving time period $T_{DRCV}$ as a protection window (step S506).

After the protection window is determined by the steps S504 and S506, the user is prompted to determine whether a time limit is to be set. When a time limit for the protection window is not requested (NO in step S507), a message received through the protection window is protected for an indefinite period (step S508). When a time limit for the protection window is requested (YES in step S507), a protection period for the protection window is set (step S509). Subsequently, the user is prompted to input deletion (DEL) or transfer (TRANS) of the received message after the expiration of the protection period (step S509). In the case where deletion (DEL) is selected, the DEL/TRANS designation data in the address time-limit setting data table 106 and/or the designated period time-limit setting data table 107 is set to DEL (step S511). Therefore, after the expiration of the protection period Tpp, that message is deleted from the protected message table 105. On the other hand, in the case where transfer (TRANS) is selected, the DEL/TRANS designation data in the address time-limit setting data table 106 and/or the designated period time-limit setting data table 107 is set to TRANS (step S512). Therefore, after the expiration of the protection period Tpp, that message is transferred from the protected message table 105 to the message main table 104.

What is claimed is:

1. A method for managing messages in a selective calling receiver, comprising the steps of:

setting, in the receiver, a predetermined number of receiving windows, including at least one protection window and at least one non-protection window;

setting a predetermined protection condition in the receiver for said at least one protection window, said predetermined protection condition including a protection time period during which a message corresponding to said protection window is to be protected from being deleted;

receiving a selective calling signal through a single receiving window of the receiving windows, the selective calling signal including a message;

storing the message into a first memory when the single receiving window is the protection window provided with the predetermined protection condition;

storing the message into a second memory when the single receiving window is the non-protection window; and managing message stores in the first memory and the second memory such that a first message stored in the first memory is manipulated based on the predetermined protection condition associated with the first message.

2. The method according to claim 1, wherein:

the predetermined protection condition comprises a protection period during which the message is protected from being deleted; and the first message stored in the first memory is manipulated based on the predetermined protection condition when the protection period is expired.

3. The method according to claim 2, wherein:

the predetermined protection condition further comprises a manipulation instruction which is to be performed when the protection period is expired; and the first message stored in the first memory is manipulated according to the manipulation instruction when the protection period is expired.

4. The method according to claim 3, wherein the manipulation instruction is a deletion instruction which deletes the first message from the first memory when the protection period is expired.

5. The method according to claim 3, wherein the manipulation instruction is a transfer instruction which transfers the first message from the first memory to the second memory when the protection period is expired.

6. The method according to claim 1, further comprising the step of:

releasing the predetermined protection condition from the first message stored in the first memory to transfer the first message from the first memory to the second memory according to a user's instruction.

7. The method according to claim 1, further comprising the step of:

setting a protection condition of a second message stored in the second memory to transfer the second message from the second memory to the first memory according to a user's instruction.

8. The method according to claim 6, further comprising the step of:

setting a protection condition of a second message stored in the second memory to transfer the second message from the second memory to the first memory according to a user's instruction.

9. The method according to claim 1, wherein the said predetermined number of receiving windows are a predetermined number of call addresses including a protection call address and a non-protection call address, the call addresses being previously assigned to the selective calling receiver, and the selective calling signal being received through a single call address of the call addresses.

10. The method according to claim 9, wherein:

the predetermined protection condition comprises a protection period during which the message is protected from being deleted; and the first message stored in the first memory is manipulated based on the predetermined protection condition when the protection period is expired.

11. The method according to claim 10, wherein:

the predetermined protection condition further comprises a manipulation instruction which is to be performed when the protection period is expired; and the first message stored in the first memory is manipulated according to the manipulation instruction when the protection period is expired.

12. The method according to claim 11, wherein the manipulation instruction is a deletion instruction which deletes the first message from the first memory when the protection period is expired.

13. The method according to claim 11, wherein the manipulation instruction is a transfer instruction which transfers the first message from the first memory to the second memory when the protection period is expired.

14. The method according to claim 9, further comprising the step of:

releasing the predetermined protection condition from the first message stored in the first memory to transfer the first message from the first memory to the second memory according to a user's instruction.

15. The method according to claim 9, further comprising the step of:

setting a protection condition of a second message stored in the second memory to transfer the second message from the second memory to the first memory according to a user's instruction.

16. The method according to claim 14, further comprising the step of:

setting a protection condition of a second message stored in the second memory to transfer the second message from the second memory to the first memory according to a user's instruction.

17. The method according to claim 1, wherein the said predetermined number of receiving windows are a predetermined number of receiving time windows including a protection time window and a non-protection time window, and the selective calling signal being received through a single receiving time window of the receiving time windows.

18. The method according to claim 17, wherein:

the predetermined protection condition comprises a protection period during which the message is protected from being deleted; and the first message stored in the first memory is manipulated based on the predetermined protection condition when the protection period is expired.

19. The method according to claim 18, wherein:

the predetermined protection condition further comprises a manipulation instruction which is to be performed when the protection period is expired; and the first message stored in the first memory is manipulated according to the manipulation instruction when the protection period is expired.

20. The method according to claim 19, wherein the manipulation instruction is a deletion instruction which deletes the first message from the first memory when the protection period is expired.

21. The method according to claim 19, wherein the manipulation instruction is a transfer instruction which transfers the first message from the first memory to the second memory when the protection period is expired.

22. The method according to claim 17, further comprising the step of:

releasing the predetermined protection condition from the first message stored in the first memory to transfer the first message from the first memory to the second memory according to a user's instruction.

23. The method according to claim 17, further comprising the step of:

setting a protection condition of a second message stored in the second memory to transfer the second message from the second memory to the first memory according to a user's instruction.

24. The method according to claim 22, further comprising the step of:

setting a protection condition of a second message stored in the second memory to transfer the second message from the second memory to the first memory according to a user's instruction.

25. The method according to claim 17, wherein the selective calling signal is received through the single receiving time window when the selective calling signal has a call address previously assigned to the selective calling receiver.

26. A selective calling receiver comprising:

first setting means for setting a predetermined number of receiving windows including at least one protection window and at least one non-protection window;

second setting means for setting a predetermined protection condition for said at least one protection window, said predetermined protection condition including a protection time period during which a message corresponding to said protection window is to be protected from being deleted;

receiving means for receiving a selective calling signal through a single receiving window of the receiving windows, the selective calling signal including a message;

first storage means for storing the message when the single receiving window is the protection window provided with the predetermined protection condition;

second storage means for storing the message when the single receiving window is the non-protection window; and management means for managing message stored in the first storage means and the second storage means such that a first message stored in the first storage means is manipulated based on the predetermined protection condition associated with the first message.

27. The selective calling receiver according to claim 26, wherein the receiving windows are a predetermined number of call addresses including a protection call address and a non-protection call address, the call addresses being previously assigned to the selective calling receiver, and the selective calling signal being received through a single call address of the call addresses.

28. The selective calling receiver according to claim 26, wherein the receiving windows are a predetermined number of receiving time windows including a protection time window and a non-protection time window, and the selective calling signal being received through a single receiving time window of the receiving time windows.

29. The selective calling receiver according to claim 28, wherein the selective calling signal is received through the single receiving time window when the selective calling signal has a call address previously assigned to the selective calling receiver.

30. The method according to claim 1, further comprising:

storing identification information in a storage means of said receiver, said identification information corresponding to said at least one protection window and said at least one non-protection window;

comparing unique information in said selective calling signal with said identification information in said storage means; and storing the message in said selective calling signal into a location in the first memory which corresponds to said protection window, said message being stored in said location based on a match between the unique information and identification information in said storage means which corresponds to the location in the first memory which corresponds to said protection window.

* * * * *